US009201322B2

(12) United States Patent
Kikushima

(10) Patent No.: US 9,201,322 B2
(45) Date of Patent: Dec. 1, 2015

(54) POSITIVELY CHARGEABLE TONER FOR ELECTROSTATIC IMAGE DEVELOPMENT AND DEVELOPER

(71) Applicant: KYOCERA Document Solutions Inc., Osaka-shi, Osaka (JP)

(72) Inventor: Seiji Kikushima, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/261,753

(22) Filed: Apr. 25, 2014

(65) Prior Publication Data

US 2014/0322644 A1 Oct. 30, 2014

(30) Foreign Application Priority Data

Apr. 25, 2013 (JP) ..... 2013-092290

(51) Int. Cl.

| | |
|---|---|
| ***G03G 9/087*** | (2006.01) |
| ***G03G 9/08*** | (2006.01) |
| ***G03G 9/097*** | (2006.01) |

(52) U.S. Cl.

CPC ..... *G03G 9/0804* (2013.01); *G03G 9/08711* (2013.01); *G03G 9/08791* (2013.01); *G03G 9/09741* (2013.01)

(58) Field of Classification Search

CPC ..... G03G 9/0804; G03G 9/08711; G03G 9/08791; G03G 9/09741

See application file for complete search history.

(56) References Cited

U.S. PATENT DOCUMENTS

| | | | | |
|---|---|---|---|---|
| 6,365,313 | B1 * | 4/2002 | Masuo et al. | 430/108.22 |
| 2006/0063082 | A1 * | 3/2006 | Mikuriya et al. | 430/108.3 |
| 2010/0124713 | A1 * | 5/2010 | Farrugia et al. | 430/108.1 |

FOREIGN PATENT DOCUMENTS

| | | |
|---|---|---|
| JP | 2007-248666 | 9/2007 |
| JP | 2012-3176 | 1/2012 |

* cited by examiner

*Primary Examiner* — Peter Vajda

(74) *Attorney, Agent, or Firm* — Gerald E. Hespos; Michael J. Porco; Matthew T. Hespos

(57) ABSTRACT

A positively chargeable toner for electrostatic image development according to the present disclosure is formed by aggregating at least binder resin-containing fine particles and colorant-containing fine particles in an aqueous medium in the presence of a dispersing agent and a metal ion to form fine particle aggregates and heating the fine particle aggregates to coalesce components in the fine particle aggregates. The binder resin used is a (meth)acrylic resin or styrene-(meth) acrylic resin having a certain quaternary ammonium group. The hydrophobicity (methanol wettability) is adjusted to a certain range.

4 Claims, No Drawings

POSITIVELY CHARGEABLE TONER FOR ELECTROSTATIC IMAGE DEVELOPMENT AND DEVELOPER

The present application is based on Japanese Patent Application No. 2013-092290 filed on Apr. 25, 2013, the contents of which are incorporated herein by reference.

BACKGROUND

The present disclosure relates to a positively chargeable toner for electrostatic image development and a developer containing the same.

In electrophotographic devices, electrostatic latent images formed on photoreceptors from developing machines using a developer containing toner are visualized by using toner and the visualized images are then transferred onto transfer bodies followed by fixation of the images onto transfer materials such as paper sheets by means of heat in order to obtain images. Full colour images can be obtained by using four toners, i.e., black, yellow, magenta and cyan and overlaying the respective toner images.

However, electrophotographic images have not reached to a satisfactory level in terms of image quality compared to high-quality images such as silver halide photography and printed matters. Therefore, further improvements in quality of images and reliability thereof are required, and it is sought to confer with toner particles reduced diameters, uniform shapes and improved charge stability and to confer with toner narrow and stable particle size distribution.

In addition, because of an increased interest about energy saving performances and environment protecting performances, toner is sought to be manufactured with materials and methods which allow fixation at decreased temperatures and have decreased impacts on the environment.

In order to achieve these aims, toner particles are required to be prepared by the method that allows the design of toner particles having desired shape and size and the structural design of the particles so that toner materials are arranged in terms of position and condition so as to be able to exhibit the maximum performances thereof.

In order to fulfil the above requirement, conventional pulverization methods in which a binder resin, a colorant, a charge controlling agent, wax and the like for toner are mixed and then pulverized have been replaced by chemical methods in which toner particles containing a colorant, a charge controlling agent, wax and the like are built up from fine particles by polymerization of monomers or by particle growth from polymers.

In such procedures, it has been reported that toner having a hydrophobicity of 30% or less can provide stable and high density printing images even after continuous printing on a high-speed image forming apparatus, cause no image fogging even after a high amount of printing and reduce scattering of the toner in the apparatus.

Among others, an emulsion aggregation method in which emulsified fine particles of materials for toner are aggregated and melt-adhered for granulation is the most ideal granulation method because the shape and particle diameter distribution of particles can be easily controlled and the structure of particles can also be controlled.

It has been reported that the emulsion aggregation toner includes crystalline polyester fine particles and wax fine particles, the crystalline polyester has a weight average molecular weight Mw of 1000 or more and 5000 or less, the wax component has a melting point of 45 to 75° C. and the toner has the methanol concentration (% by volume) of 30 to 70% at the transmittance of 50% in methanol wettability. The toner has significantly improved developing properties in terms of development streaks and fogging and improved fixing performances in terms of image frictional properties and image peeling.

SUMMARY

Thus a positively chargeable toner for electrostatic image development according to an aspect of the present disclosure is characterized in that: the toner is formed by aggregating at least binder resin-containing fine particles and colorant-containing fine particles in an aqueous medium in the presence of a dispersing agent and a metal ion to form fine particle aggregates and heating the fine particle aggregates to coalesce components in the fine particle aggregates, the binder resin is a (meth)acrylic resin or styrene-(meth)acrylic resin having a quaternary ammonium group, concentration of a monomer, which has the quaternary ammonium group, in the (meth) acrylic resin or the styrene-(meth)acrylic resin is 1 to 45% by mass, and the toner has a hydrophobicity (methanol wettability) of 5 to 40%.

DETAILED DESCRIPTION

Embodiments according to the present disclosure are hereinafter specifically described. However, the present disclosure is not limited to the embodiments.

The positively chargeable toner for electrostatic image development (which may be hereinafter merely referred to as "toner") according to the present embodiment is toner for electrostatic image development which is formed by aggregating binder resin-containing fine particles and colorant-containing fine particles in an aqueous medium in the presence of a dispersing agent and a metal ion to form fine particle aggregates and heating the fine particle aggregates to coalesce the components in the fine particle aggregates and has a hydrophobicity (methanol wettability) of 5 to 40%.

The toner having the above configurations has sufficient positive charge to achieve excellent charging ability and has decreased hydrophobicity to suppress deterioration in storage stability due to residual auxiliary materials (dispersing agent and the like) during granulation. Further, washing of the dispersing agent and metal ion during toner production using the emulsion aggregation method can be facilitated, toner particles are prevented from undergoing viscosity change and both storage stability at high temperatures and fixing performance can be obtained, thereby providing excellent images without fogging.

According to the present disclosure, a positively chargeable toner for electrostatic image development can be provided which has excellent charging ability, storage stability at high temperatures and fixing performance and can provide excellent images without fogging.

In the present embodiment, the hydrophobicity (methanol wettability) is defined as follows:

$$\text{Hydrophobicity}=(\text{amount of methanol}/(\text{amount of ion exchange water}+\text{amount of methanol}))\times 100(\%).$$

The hydrophobicity (methanol wettability) can be adjusted by introducing, for example, a polar functional group (in the present embodiment, a quaternary ammonium group and the like).

The binder resin contained in the toner is a (meth)acrylic resin or styrene-(meth)acrylic resin having a quaternary ammonium group. The (meth)acrylic resin or the styrene- (meth)acrylic resin has the concentration of a monomer having a quaternary ammonium group of 1 to 45% by mass.

The toner of the present embodiment may further include, in addition to the binder resin and the colorant, components such as a mould release agent, a charge controlling agent and/or magnetic powder. The toner may optionally contain an external additive attached on the surface thereof. The toner may be mixed with a desired carrier to be used as a two-component developer.

Essential or optional components of the toner of the present embodiment, i.e., the binder resin, colorant, mould release agent, charge controlling agent, magnetic powder and external additive, the carrier which may be used when the toner of the present embodiment is used as a two-component developer, and a method for producing the positively chargeable toner for electrostatic image development of the present embodiment are hereinafter specifically described.

[Binder Resin]

The toner of the present embodiment contains, as a binder resin, a (meth)acrylic resin or styrene-(meth)acrylic resin having a quaternary ammonium group (hereinafter also referred to as merely "quaternary ammonium group-containing resin"). The (meth)acrylic resin or the styrene-(meth) acrylic resin has the concentration of a monomer having a quaternary ammonium group of 1 to 45% by mass.

When such a resin is used as a binder resin, toner has sufficient positive charge to achieve excellent charging ability and has decreased hydrophobicity to suppress deterioration in storage stability of toner due to residual auxiliary materials (dispersing agent and the like) during granulation.

The acrylic resin according to the present embodiment is not particularly limited as far as it has the above property and may be selected, as appropriate, from acrylic resins which have been conventionally used as a binder resin for toner.

The (meth)acrylic resin or styrene-(meth)acrylic resin having a quaternary ammonium group has a basic skeleton of (meth)acrylic resin or styrene-(meth)acrylic resin. However, when merely "(meth)acrylic resin" and "styrene-(meth) acrylic resin" without a modifier of "having a quaternary ammonium group" are referred in the specification and claims of the present application, the (meth)acrylic resin and the styrene-(meth)acrylic resin do not encompass the (meth) acrylic resin having a quaternary ammonium group and the styrene-(meth)acrylic resin having a quaternary ammonium group.

(Meth)Acrylic Resin Having a Quaternary Ammonium Group

The (meth)acrylic resin having a quaternary ammonium group may be prepared by polymerizing monomer composition containing a monomer having a quaternary ammonium group and a (meth)acrylic monomer or polymerizing monomer composition containing a monomer having a tertiary amino group and a (meth)acrylic monomer, followed by conversion of the tertiary amino group to a quaternary ammonium group.

Among others, polymerization of monomer composition containing a monomer having a quaternary ammonium group and a (meth)acrylic monomer is more suitable because a desired resin can be easily obtained. The monomers used for this method are hereinafter described.

The monomer having a quaternary ammonium group can be prepared by converting a tertiary amino group in a monomer having the tertiary amino group to a quaternary ammonium group. The monomer having a tertiary amino group is preferably a dialkylaminoalkyl (meth)acrylate, a dialkylamino (meth)acrylamide and a dialkylaminoalkyl (meth) acrylamide. Specific examples of the dialkylaminoalkyl (meth)acrylate may include dimethylaminoethyl (meth)acrylate, diethylaminoethyl(meth)acrylate, dipropylaminoethyl (meth)acrylate and dibutylaminoethyl (meth)acrylate, specific examples of the dialkyl (meth)acrylamide may include dimethyl methacrylamide and specific examples of the dialkylaminoalkyl (meth)acrylamide may include dimethylaminopropyl methacrylamide.

A reagent used for conversion of a tertiary amino group to a quaternary ammonium group may include alkyl halides having 1 or more and 6 or less carbon atoms such as methyl chloride, methyl bromide and ethyl chloride; alkyl sulphate esters having 1 or more and 6 or less carbon atoms such as dimethyl sulphate, diethyl sulphate, methyl benzenesulfonate and methyl p-toluenesulfonate; and aralkyl halides having 7 or more and 10 or less carbon atoms such as benzyl chloride.

The (meth)acrylic monomer used for preparation of the (meth)acrylic resin having a quaternary ammonium group may include (meth)acrylic acid; alkyl(meth)acrylates such as methyl (meth)acrylate, ethyl (meth)acrylate and propyl (meth)acrylate; (meth)acrylamide compounds such as (meth) acrylamide, N-alkyl (meth)acrylamides, N-aryl (meth)acrylamides, N,N-dialkyl (meth)acrylamides and N,N-diaryl (meth)acrylamides.

Monomers other than the monomer having a quaternary ammonium group or the (meth)acrylic monomer which may be used for preparation of the (meth)acrylic resin having a quaternary ammonium group may include, for example, olefins such as ethylene, propylene, butene-1, pentene-1, hexene-1, heptene-1 and octene-1; allyl esters such as allyl acetate, allyl benzoate, allyl acetoacetate and allyl lactate; vinyl ethers such as hexyl vinyl ether, octyl vinyl ether, ethylhexyl vinyl ether, methoxyethyl vinyl ether, ethoxyethyl vinyl ether, chloroethyl vinyl ether, 2-ethylbutyl vinyl ether, dimethylaminoethyl vinyl ether, diethylaminoethyl vinyl ether, benzyl vinyl ether, vinyl phenyl ether, vinyl tolyl ether, vinyl chlorophenyl ether, vinyl-2,4-dichlorophenyl ether and vinyl naphthyl ether; and vinyl esters such as vinyl acetate, vinyl propionate, vinyl butyrate, vinyl isobutyrate, vinyl diethylacetate, vinyl chloroacetate, vinyl methoxyacetate, vinyl butoxyacetate, vinyl phenylacetate, vinyl acetoacetate, vinyl lactate, vinyl benzoate, vinyl salicylate, vinyl chlorobenzoate and vinyl naphthoate.

The (meth)acrylic resin having a quaternary ammonium group can be obtained by polymerizing the monomer having a quaternary ammonium group, the (meth)acrylic monomer and an optional monomer other than the monomer having a quaternary ammonium group and the (meth)acrylic monomer according to a well known method.

The (meth)acrylic resin having a quaternary ammonium group preferably contain the unit derived from the (meth) acrylic monomer at 40%/by mass or more and particularly preferably 60% by mass or more. When the unit derived from the monomer having a quaternary ammonium group is the unit derived from the (meth)acrylic monomer having a quaternary ammonium group, the unit derived from the (meth) acrylic monomer includes the unit derived from the (meth) acrylic monomer having a quaternary ammonium group.

Styrene-(Meth)Acrylic Resin Having a Quaternary Ammonium Group

The styrene-(meth)acrylic resin having a quaternary ammonium group can be prepared in a similar manner as the (meth)acrylic resin having a quaternary ammonium group except that a styrene monomer is further copolymerized.

The styrene monomer used for preparation of the styrene-(meth)acrylic resin may include styrene, α-methylstyrene, o-methylstyrene, m-methylstyrene, p-methylstyrene, p-ethylstyrene, 2,4-dimethylstyrene, p-n-butylstyrene, p-dodecylstyrene, p-methoxystyrene, p-phenylstyrene and p-chlorostyrene.

The styrene-(meth)acrylic resin having a quaternary ammonium group preferably contains the unit derived from the styrene monomer and the unit derived from the (meth) acrylic monomer in total at 40% by mass or more and particularly preferably 60% by mass or more. When the unit derived from the monomer having a quaternary ammonium group is the unit derived from the (meth)acrylic monomer having a quaternary ammonium group, the unit derived from the (meth)acrylic monomer includes the unit derived from the (meth)acrylic monomer having a quaternary ammonium group.

The (meth)acrylic resin or the styrene-(meth)acrylic resin preferably has the concentration of a monomer having a quaternary ammonium group of 1 to 45% by mass. When the concentration of the monomer having a quaternary ammonium group is less than 1% by mass, the obtained toner particles may not have a decreased hydrophobicity, contain the residual dispersing agent and have decreased charging ability, resulting in fogging of images formed with the toner. When the concentration is higher than 45% by mass, the obtained toner particles may have decreased hydrophobicity (preferable washing properties), however, fine particles may be aggregated (toner may have a decreased storage stability) due to an excessively high concentration of the quaternary ammonium group.

The concentration of the monomer having a quaternary ammonium group in the (meth)acrylic resin or styrene-(meth) acrylic resin can be adjusted by, for example, adjusting the amount loaded upon production of the resin composition.

The quaternary ammonium group-containing resin according to the present embodiment preferably has a melting point of 80° C. or higher and 150° C. or lower, more preferably 90° C. or higher and 140° C. or lower and still more preferably 100° C. or higher and 130° C. or lower. When the quaternary ammonium group-containing resin has an excessively high melting point, the temperature at which the toner may be fixed may be increased or spherodizing of toner may be difficult in some cases. When the quaternary ammonium group-containing resin has an excessively low melting point, toner may be excessively spherodized. The melting point of the quaternary ammonium group-containing resin can be determined by using, for example, a flowtester CFT-500D from Shimadzu Corporation and the like.

In the present embodiment, the quaternary ammonium group-containing resin preferably has a glass transition point (Tg) of 40° C. or higher and 80° C. or lower, more preferably 50° C. or higher and 70° C. or lower and still more preferably 55° C. or higher and 65° C. or lower. When the quaternary ammonium group-containing resin has an excessively low Tg, toner may have a deteriorated storage stability. When the quaternary ammonium group-containing resin has an excessively high Tg, toner may have an excessively high melting point. The glass transition point of the quaternary ammonium group-containing resin can be determined by using, for example, a flowtester CFT-500D from Shimadzu Corporation and the like.

The binder resin may contain a thermoplastic resin other than the quaternary ammonium group-containing resin within the range that does not inhibit the purpose of the present disclosure. When the binder resin contains the quaternary ammonium group-containing resin and another thermoplastic resin in combination, the thermoplastic resin other than the quaternary ammonium group-containing resin may be appropriately selected from thermoplastic resins which are used as conventional binder resins for toner.

The amount of the quaternary ammonium group-containing resin in the binder resin is not particularly limited as far as it does not inhibit the purpose of the present disclosure. The amount of the quaternary ammonium group-containing resin in the binder resin is preferably 70% by mass or more, more preferably 80% by mass or more, still more preferably 90% by mass or more and the most preferably 100%.

In the present embodiment, the binder resin may be resin fine particles containing the quaternary ammonium group-containing resin as a core and a coating layer of a material containing a specific resin without a chargeable functional group.

In this case, the coating layer may be formed with, for example, a material containing one or more resins selected from the group consisting of (meth)acrylic resins and styrene-(meth)acrylic resins. The (meth)acrylic resins and the styrene-(meth)acrylic resins in this context are similar to the (meth)acrylic resin having a quaternary ammonium group and the styrene-(meth)acrylic resin having a quaternary ammonium group except that the unit having a quaternary ammonium group is omitted.

The (meth)acrylic resin preferably contains the unit derived from the (meth)acrylic monomer at 80% by mass or more, more preferably 90% by mass or more and still more preferably 100% by mass. The styrene-(meth)acrylic resin preferably contains the unit derived from the styrene monomer and the unit derived from the (meth)acrylic monomer in total at 80%/by mass or more, more preferably 90% by mass or more and still more preferably 100% by mass.

The coating layer may contain a resin other than the (meth) acrylic resin and the styrene-(meth)acrylic resin. Suitable examples of the resin other than the (meth)acrylic resin and the styrene-(meth)acrylic resin which may be contained in the coating layer may include the same resins which are mentioned above as suitable resins for the binder resin. The coating layer preferably contain the resin selected from (meth) acrylic resins and styrene-(meth)acrylic resins at 70% by mass or more, more preferably 80% by mass or more, still more preferably 90% by mass or more and the most preferably 100% by mass.

The coating layer is preferably, relative to 100 parts by mass of core particles, 30 parts by mass or more and 70 parts by mass or less and more preferably 40 parts by mass or more and 60 parts by mass or less.

[Colorant]

The toner of the present embodiment contains a colorant. The colorant added to toner may be well known pigments and dyes according to the colour of toner particles. Specific examples of suitable colorants that can be added to toner may include the following colorants.

Black colorants may include carbon black. Specifically methioned are Raven 1060, 1080, 1170, 1200, 1250, 1255, 1500, 2000, 3500, 5250, 5750, 7000, 5000 ULTRA II and 1190 ULTRA II from Columbian Carbon Ltd.; Black Pearls L. Mogul-L, Rega 1400R, 660R, 330R, Monarch 800, 880, 900, 1000, 1300 and 1400 from Cabot Corporation; Color Black FW1, FW2, FW200, 18, S160, S170, Special Black 4, 4A, 6, Printex 35, U, 140U, V and 140V from Degussa; and No. 25, 33, 40, 47, 52, 900, 2300, MCF-88, MA600, 7, 8 and 100 from Mitsubishi Chemical Corporation. The black colorant may be a colorant formed by toning colorants, such as a yellow colorant, a magenta colorant and a cyan colorant as described hereinbelow, to obtain a black colorant.

The colorant for colour toner may include colorants such as a yellow colorant, a magenta colorant and a cyan colorant.

The yellow colorant may include colorants such as condensed azo compounds, isoindolinone compounds, anthraquinone compounds, azo-metal complexes, methine compounds and allylamide compounds. Specifically mentioned are C.I. pigment yellow 12, 13, 14, 15, 17, 62, 74, 83, 93, 94, 95, 97, 109, 110, 111, 120, 127, 128, 129, 147, 151, 154, 155, 168, 174, 175, 176, 180, 181, 191 and 194.

The magenta colorant may include colorants such as condensed azo compounds, diketopyrrolopyrrole compounds, anthraquinone compounds, quinacridone compounds, base dye lake compounds, naphthol compounds, benzimidazolone compounds, thioindigo compounds and perylene compounds. Specifically mentioned are C.I. pigment red 2, 3, 5, 6, 7, 19, 23, 48:2, 48:3, 48:4, 57:1, 81:1, 122, 144, 146, 150, 166, 169, 177, 184, 185, 202, 206, 220, 221 and 254.

The cyan colorant may include colorants such as copper phthalocyanine compounds, copper phthalocyanine derivatives, anthraquinone compounds and base dye lake compounds. Specifically mentioned are C.I. pigment blue 1, 7, 15, 15:1, 15:2, 15:3, 15:4, 60, 62 and 66.

These colorants may be used alone or mixed. The amount of the colorant used is not particularly limited within the range that does not inhibit the purpose of the present disclosure. Specifically, the amount of the colorant used is preferably, relative to 100 parts by mass of the total amount of toner, 3 parts by mass or more and 15 parts by mass or less.

[Mould Release Agent]

The toner of the present embodiment preferably contains a mould release agent for the purpose of improving fixing performance or offset resistance. The type of the mould release agent is not particularly limited as far as it is conventionally used as a mould release agent for toner.

Suitable mould release agents may include aliphatic hydrocarbon waxes such as low molecular weight polyethylene, low molecular weight polypropylene, polyolefin copolymers, polyolefin wax, microcrystalline wax, paraffin wax and Fischer-Tropsch wax; oxidized aliphatic hydrocarbon waxes such as oxidized polyethylene wax and block copolymers of oxidized polyethylene wax; plant waxes such as candelilla wax, carnauba wax, vegetable wax, jojoba wax and rice wax; animal waxes such as bees wax, lanolin and whale wax; mineral waxes such as ozocerite, ceresin and petrolatum; waxes mainly containing fatty acid esters such as montanic acid ester wax and castor wax; and waxes obtained by partially or totally deoxidizing fatty acid esters such as deoxidized carnauba wax.

The amount of the mould release agent used is preferably 5% by mass or more and 20% by mass or less and more preferably 8% by mass or more and 15% by mass or less.

[Charge Controlling Agent]

The toner for electrostatic image development of the present embodiment may further contain a charge controlling agent, if necessary. The charge controlling agent may be used in order to obtain toner having stabilized charge level, improved charge rising property which indicates whether or not the toner can be charged in a short time to a certain charge level and excellent durability and stability. The toner of the present embodiment contains, as a binder resin, the (meth) acrylic resin or styrene-(meth)acrylic resin having a quaternary ammonium group, and thus is used as positively chargeable toner. Therefore, for the charge controlling agent, a positive chargeable charge controlling agent is used.

The type of the charge controlling agent can be appropriately selected from charge controlling agents which are conventionally used for toner. Specific examples of the positive chargeable charge controlling agent may include azine compounds such as pyridazine, pyrimidine, pyrazine, ortho-oxazine, meta-oxazine, para-oxazine, ortho-thiazine, meta-thiazine, para-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline and quinoxaline; direct dyes made from azine compounds such as Azine Fast Red FC, Azine Fast Red 12BK, Azine Violet BO, Azine Brown 3G, Azine Light Brown GR, Azine Dark Green BH/C, Azine Deep Black EW and Azine Deep Black 3RL; nigrosin compounds such as nigrosin, nigrosin salts and nigrosin derivatives; acid dyes made from nigrosin compounds such as Nigrosin BK, Nigrosin NB and Nigrosin Z; metal salts of naphthenic acid or higher fatty acids; alkoxyl amines; alkyl amides; quaternary ammonium salts such as benzylmethylhexyldecyl ammonium and decyltrimethyl ammonium chloride. Among these positive chargeable charge controlling agents, quaternary ammonium salts are particularly preferred because of the fast charge rising property. Two or more of the positive chargeable charge controlling agents may be used in combination.

The positive chargeable charge controlling agent may be a resin having a quaternary ammonium salt, a carboxylate salt or a carboxyl group as a functional group. More specifically mentioned are styrene resins having a quaternary ammonium salt, acrylic resins having a quaternary ammonium salt, styrene-acrylic resins having a quaternary ammonium salt, polyester resins having a quaternary ammonium salt, styrene resins having a carboxylate salt, acrylic resins having a carboxylate salt, styrene-acrylic resins having a carboxylate salt, polyester resins having a carboxylate salt, styrene resins having a carboxyl group, acrylic resins having a carboxyl group, styrene-acrylic resins having a carboxyl group and polyester resins having a carboxyl group. These resins may be oligomers or polymers in terms of molecular weight.

When the positive chargeable charge controlling agent is used, the amount thereof is not particularly limited within the range that does not inhibit the purpose of the present disclosure. Typically, the amount is preferably, relative to 100 parts by mass of the total amount of toner, 1.5 parts by mass or more and 15 parts by mass or less, more preferably 2.0 parts by mass or more and 8.0 parts by mass or less and still more preferably 3.0 parts by mass or more and 7.0 parts by mass or less.

[External Additive]

The toner of the present embodiment may be subjected to surface treatment with an external additive, if desired. The particles to be treated with the external additive may also be herein referred to as toner mother particles. The type of the external additive may be appropriately selected from external additives which are conventionally used for toner. Specific examples of suitable external additives may include silica and metal oxides such as alumina, titanium oxide, magnesium oxide, zinc oxide, strontium titanate and barium titanate. Two or more external additives may be used in combination.

The particle diameter of the external additive is not limited as far as it is within the range that does not inhibit the purpose of the present disclosure and is typically and preferably 0.01 μm or more and 1.0 μm or less.

The amount of the external additive used is not particularly limited as far as it is within the range that does not inhibit the purpose of the present disclosure. Typically, the amount of the external additive used is preferably, relative to 100 parts by mass of toner mother particles, 0.1 parts by mass or more and 10 parts by mass or less and more preferably 0.2 parts by mass or more and 5 parts by mass or less.

[Carrier]

The toner of the present embodiment may be mixed with a desired carrier to be used as a two-component developer. When the two-component developer is prepared, it is preferable to use a magnetic carrier.

Suitable carrier may include the one including a carrier core material coated with a resin. Specific examples of carrier core materials may include metal particles such as iron, oxidized iron, reduced iron, magnetite, copper, silicon steel, ferrite, nickel and cobalt; alloy particles of the material described above and a metal such as manganese, zinc and aluminium; iron alloy particles such as iron-nickel alloy and iron-cobalt alloy; ceramic particles such as titanium oxide, aluminium oxide, copper oxide, magnesium oxide, lead oxide, zirconium oxide, silicon carbide, magnesium titanate, barium titanate, lithium titanate, lead titanate, lead zirconate and lithium niobate; high permittivity particles such as ammonium dihydrogen phosphate, potassium dihydrogen phosphate and Rochelle salt; and resin carriers containing the above magnetic particles dispersed in a resin.

Specific examples of the resin coating the carrier core material may include (meth)acrylic polymers, styrene polymers, styrene-(meth)acrylic copolymers, olefin polymers (polyethylene, chlorinated polyethylene, polypropylene), polyvinyl chloride, polyvinyl acetate, polycarbonate, cellulose resins, polyester resins, unsaturated polyester resins, polyamide resins, polyurethane resins, epoxy resins, silicone resins, fluororesins (polytetrafluoroethylene, polychlorotrifluoroethylene, polyvinylidene fluoride), phenol resins, xylene resins, diallylphthalate resins, polyacetal resins and amino resins. Two or more of these resins may be used in combination.

The carrier preferably has a particle diameter as measured with an electron microscope of 20 μm or more and 120 μm or less and more preferably 25 μm or more and 80 μm or less.

When the toner of the present embodiment is used in a two-component developer, the amount of toner in the two-component developer is preferably, relative to the mass of the two-component developer, 3% by mass or more and 20% by mass or less and more preferably 5% by mass or more and 15% by mass or less. The two-component developer containing the toner within the above range allows maintenance of image density of formed images at a suitable level and suppression of toner scattering from developing units, thereby preventing pollution in image forming apparatuses with toner and adhesion of toner to record media such as transfer paper sheets.

[Production Method of Toner]

The toner of the present embodiment as described above is formed by aggregating binder resin-containing fine particles and colorant-containing fine particles in an aqueous medium in the presence of a dispersing agent and a metal ion to form fine particle aggregates and heating the fine particle aggregates to coalesce the components in the fine particle aggregates.

More specifically, the method for producing the toner of the present embodiment includes the following steps (I) and (II):

(I) the fine particle aggregates formation step in which the binder resin-containing fine particles and the colorant-containing fine particles are aggregated in the aqueous medium in the presence of the dispersing agent and the metal ion to form fine particle aggregates; and (II) the coalescence step in which fine particle aggregates are heated in the aqueous medium to coalesce the components in the fine particle aggregates.

The method for producing the toner of the present disclosure may optionally include the following steps (III) to (V) in addition to the steps (I) and (II).

Step (III): the washing step in which toner is washed.

Step (IV): the drying step in which toner is dried.

Step (V): the external addition step in which an external additive is attached on the surface of the toner mother particles.

The steps (I) to (V) are sequentially described hereinbelow.

(Step (I): Fine Particle Aggregates Formation Step)

In the step (I), the binder resin-containing fine particles and the colorant-containing fine particles are aggregated in the aqueous medium in the presence of the dispersing agent and the metal ion to form fine particle aggregates.

The method for forming the fine particle aggregates may be appropriately selected from conventionally known methods. The binder resin-containing fine particles and the colorant-containing fine particles are preferably prepared so as to obtain a dispersion of fine particles, having a desired size, of these components or a composition including these components in the aqueous medium. Upon aggregation of fine particles, it is preferable to optionally use fine particles of a mould release agent in combination.

A method for preparing the binder resin-containing fine particles, a method for preparing fine particles of the colorant, a method for preparing fine particles containing a mould release agent and a method for aggregation of fine particles are sequentially described hereinafter.

<Method for Preparing Binder Resin-Containing Fine Particles>

A suitable example of the method for preparing the binder resin-containing fine particles is described hereinafter. However, the method for preparing the binder resin-containing fine particles is not limited to the method described hereinafter.

First, the binder resin and an optional component such as a colorant, a charge controlling agent and magnetic powder are mixed in a mixer such as a Henschel mixer (Mitsui Mining Co., Ltd.). The obtained mixture is then subjected to melt-kneading in a kneading machine such as a twin-screw extruder, a three-roll kneader or a two-roll kneader to obtain a binder resin composition. The obtained binder resin composition is cooled and then coarsely pulverized in a pulverizer such as a turbo mill, a cutting mill, a feather mill or a jet mill. The binder resin composition preferably has a particle diameter after the coarsely pulverizing of about 400 μm. When the binder resin is not mixed with the above optional component, the binder resin may be coarsely pulverized in the pulverizer to obtain a coarsely pulverized binder resin having a particle diameter of about 400 μm.

The coarsely pulverized binder resin composition or binder resin dispersed in the aqueous medium is heated to a temperature that is 10° C. or more higher than the softening point of the binder resin as measured on a flowtester and a high shear force is applied to the heated dispersion of the binder resin composition by means of a Nanomizer (Yoshida Kikai Co., Ltd.) or a high pressure disperser to obtain a dispersion of the binder resin-containing fine particles in the aqueous medium.

The apparatus which applies high shear force to the dispersion may include a NANO 3000 (Biryu K.K.), a Homogenizer (IKA), a Microfluidizer (MFI), a Gaulin homogenizer (Manton-Gaulin Co.) and a Clearmix W-Motion (M Technique Co., Ltd).

The aqueous medium may be a liquid medium mainly containing water, and water contained in the aqueous medium may be appropriately selected from various kinds of water such as clean water, industrial water, distilled water and ion exchange water.

The aqueous medium may contain an organic solvent. When the aqueous medium contains the organic solvent, the amount of the organic solvent is preferably, relative to the mass of the aqueous medium, 20% by mass or less, more preferably 10% by mass or less and still more preferably 5% by mass or less. The organic solvent which the aqueous medium may contain may include alcohols such as methanol and ethanol, ethers such as tetrahydrofuran, ketones such as acetone, nitrogen-containing polar organic solvents such as N,N-dimethylformamide, N,N-dimethylacetamide and N-methyl-2-pyrrolidone.

The amount of the aqueous medium relative to the binder resin composition or binder resin is not particularly limited as far as the formation of fine particles of the binder resin composition or binder resin proceeds preferably. Typically, the amount by mass of the aqueous medium relative to the binder resin is, although it may vary according to the apparatus used for preparation of the fine particles, preferably 1 or more and 12 or less times and more preferably 2 or more and 10 or less times of the mass of the binder resin.

The dispersion of the binder resin-containing fine particles in the aqueous medium may contain a dispersing agent. The dispersing agent may include surfactants. When the aqueous medium dispersion of the binder resin-containing fine particles contains a surfactant, the binder resin-containing fine particles can be stably dispersed in the aqueous medium.

The surfactant which may be added to the aqueous medium dispersion of the binder resin-containing fine particles may be appropriately selected from the group consisting of anionic surfactants, cationic surfactants and nonionic surfactants. Anionic surfactants may include sulphate ester surfactants, sulfonate salt surfactants, phosphate ester surfactants and soaps. Cationic surfactants may include amine salt surfactants and quaternary ammonium salt surfactants. Nonionic surfactants may include, for example, polyethylene glycol surfactants, alkylphenol ethylene oxide adduct surfactants and polyhydric alcohol surfactants which are derivatives of polyhydric alcohols such as glycerol, sorbitol and sorbitan. Among these surfactants, at least one of anionic surfactants and nonionic surfactants is preferably used. One or two or more in combination of these surfactants may be used.

The amount of the surfactant used is preferably, relative to the mass of the binder resin composition or binder resin, 1% by mass or more and 10% by mass or less.

The fine particles in the dispersion of the binder resin-containing fine particles preferably have a volume average particle diameter (D50) of 1 μm or less and more preferably 0.1 μm or more and 0.3 μm or less. The volume average particle diameter (D50) of fine particles can be determined on a laser diffraction particle size distribution analyzer.

<Method for Preparation of Fine Particles of Colorant>

A suitable example of the method for preparing the fine particles of the colorant is described hereinafter. However, the method for preparing the fine particles of the colorant is not limited to the method described hereinafter.

The colorant-containing fine particles are obtained by dispersing, in an aqueous medium containing a surfactant, the colorant and an optional component such as a dispersing agent for the colorant using a well known disperser. The type of the surfactant is not particularly limited and may be any of anionic surfactants, cationic surfactants and nonionic surfactants. The amount of the surfactant is not particularly limited and is preferably at or higher than the critical micelle concentration (CMC).

The apparatus which applies a high shear force to the dispersion may include the same apparatuses as those used for preparation of the binder resin-containing fine particles. The aqueous medium, organic solvent and surfactant which may be used for preparation of the fine particles of the colorant may be the same as the aqueous medium, organic solvent and surfactant used for preparation of the binder resin-containing fine particles.

The fine particles of the colorant preferably have a volume average particle diameter (D50) of 0.05 μm or more and 0.2 μm or less.

<Method for Preparing Fine Particles Containing Mould Release Agent>

A suitable example of the method for preparing the fine particles containing the mould release agent is described hereinafter. However, the method for preparing the fine particles containing the mould release agent is not limited to the method described hereinafter.

First, the mould release agent is preliminarily pulverized to around 400 μm to obtain mould release agent powder. The mould release agent powder is added to an aqueous medium containing a surfactant to prepare slurry. The obtained slurry is then heated to a temperature at or higher than the melting point of the mould release agent. A high shear force is applied to the heated slurry by means of a Nanomizer (Yoshida Kikai Co., Ltd.) or a high pressure disperser to obtain an aqueous dispersion of the mould release agent fine particles.

The apparatus which applies a high shear force to the dispersion may include the same apparatuses as those used for preparation of the binder resin-containing fine particles. The aqueous medium, organic solvent and surfactant which may be used for preparation of the fine particles containing the mould release agent may be the same as the aqueous medium, organic solvent and surfactant used for preparation of the binder resin-containing fine particles.

The fine particles in the dispersion of the fine particles containing the mould release agent preferably have a volume average particle diameter (D50) of 1 μm or less and more preferably 0.1 μm or more and 0.3 μm or less. The volume average particle diameter (D50) of the fine particles can be determined on a laser diffraction particle size distribution analyzer.

Although methods for separately preparing fine particles containing the binder resin, the colorant and the mould release agent have been exemplified hereinabove, fine particles may also be prepared which contain, for example, the binder resin and the colorant or the binder resin and the mould release agent. Further, the binder resin may be resin fine particles coated by a coating layer of another resin.

<Aggregation Method of Fine Particles>

Various fine particles prepared by the methods described above are used for formation of fine particle aggregates by aggregating the binder resin-containing fine particles and the colorant-containing fine particles in the aqueous medium in the presence of the dispersing agent and the metal ion. Optionally, the aqueous medium dispersion may further contain fine particles of the mould release agent.

The fine particles in the present embodiment are aggregated by adding to the dispersion of the fine particles in the aqueous medium the dispersing agent and the metal ion (coagulant).

The dispersing agent may include anionic surfactants, cationic surfactants and nonionic surfactants as described above. Preferably, because aggregation is easily controlled, anionic surfactants, sodium lauryl sulphate (SDS), dodecyl benzene sulfonate (DBS) and the like are preferably used.

The metal ion may include inorganic metal salts, inorganic ammonium salts and divalent or higher valent metal complexes. The inorganic metal salts may include metal salts such as sodium sulphate, sodium chloride, calcium chloride, calcium nitrate, barium chloride, magnesium chloride, zinc chloride, aluminium chloride and aluminium sulphate and inorganic salt polymers such as polyaluminium chloride and polyaluminium hydroxide. The inorganic ammonium salts may include ammonium sulphate, ammonium chloride and ammonium nitrate. Quaternary ammonium salt cationic surfactants and polyethyleneimine may also be used as the coagulant.

The metal ion is preferably a divalent metal salt and a monovalent metal salt. The divalent metal salt and the monovalent metal salt are preferably used in combination. The divalent metal salt exhibits high aggregation speed of fine particles while the monovalent metal salt exhibits low aggregation speed of fine particles. Therefore, the aggregation speed of the fine particles can be adjusted by adding, as the coagulant the divalent metal salt and then adding the monovalent metal salt. By utilizing the difference in the aggregation speed of the fine particles between the divalent metal salt and monovalent metal salt, the combined use thereof allows to control the particle diameter of the obtained fine particle aggregates and to obtain a sharp particle size distribution of the fine particle aggregates.

The amount of the coagulant added is preferably, relative to a solid matter of the fine particle dispersion, about 1 to 50%. It is also preferable that the amount of the coagulant is appropriately adjusted according to the type and amount of the surfactant in the fine particle dispersion.

In order to promote aggregation of the fine particles, it is preferable to provide heating appropriately. When the fine particle aggregates are aggregated to have a desired particle diameter, heating is stopped and aggregation can be halted. Alternatively, an aggregation terminating agent may be added after a desired aggregation is obtained. The aggregation terminating agent may include, for example, sodium chloride and sodium hydroxide. The fine particle aggregates can be obtained according to the above method.

(Step (II): Coalescence Step)

In the coalescence step, the fine particle aggregates obtained in the step (I) are heated in the aqueous medium to coalesce the components in the fine particle aggregates and form toner particles. In the coalescence step, the fine particle aggregates are heated and thus the shape of the fine particle aggregates gradually approaches sphere because the melt viscosity of the binder resin decreases due to heating and the shape of the fine particle aggregates is changed towards sphere due to surface tension. By controlling the temperature and time of the heating, the degree of sphericity of the obtained toner particles can be controlled as desired.

The temperature at which the fine particle aggregates are heated in the coalescence step is not particularly limited as far as the components in the fine particle aggregates are preferably coalesced. The temperature at which the fine particle aggregates are heated is preferably 10° C. or more higher than the glass transition point (Tg) of the binder resin and lower than the melting point (Tm) of the binder resin. By heating the fine particle aggregates at a temperature in the above range, components in the fine particle aggregates are preferably coalesced and toner having a suitable degree of sphericity can be easily prepared.

(Step (III): Washing Step)

Toner particles may be optionally washed with water. The method for washing is not particularly limited and may include a method in which toner particles are recovered from the aqueous medium dispersion containing toner particles by solid-liquid separation as a wet cake which is then washed with water and a method in which toner particles in the aqueous medium dispersion containing toner particles are precipitated, the supernatant is replaced by water and toner particles are then again dispersed in water.

(Step (IV): Drying Step)

Toner particles may be optionally dried. The method for drying the toner particles is not particularly limited. A suitable drying method may include a method using a dryer such as a spray dryer, a fluidized bed dryer, a vacuum freeze dryer and a reduced pressure dryer. Among them, a method using a spray dryer is more preferred because aggregation of toner particles during drying can be easily suppressed. When a spray dryer is used, the dispersion of toner particles may be sprayed with a dispersion of an external additive such as silica in order to attach the external additive on the surface of the toner particles.

(Step (V): External Addition Step)

The toner of the present embodiment may optionally contain an external additive attached on the surface thereof. The external additive is attached on the toner mother particles obtained by combination of the steps (I) and (II) and the step (III) and/or step (IV). The external additive may be suitably attached on the surface of the toner mother particles by mixing the toner mother particles and the external additive in a mixer such as a Henschel mixer or a Nauta mixer by adjusting the condition so that the external additive is not embedded in the surface of the toner mother particles.

The positively chargeable toner for electrostatic image development of the present embodiment as described above has excellent charging ability, storage stability at high temperatures and fixing performance and can provide excellent images without fogging. Therefore, the toner of the present embodiment is suitably used in various image forming apparatuses.

EXAMPLES

The present disclosure is further specifically described hereinafter by means of Examples which do not limit the present disclosure.

Preparation Example 1

[Preparation of Dispersion of Binder Resin Fine Particles]

(Acrylic Resin Fine Particle Dispersion A)

To a 2-L flask equipped with a stirrer, a condenser, a thermometer and a nitrogen introducing tube was added 180 g of isobutanol as a reaction solvent, 18 g of diethylaminoethyl methacrylate and 18 g of methyl para-toluenesulfonate were further added and the mixture was stirred under a nitrogen atmosphere at 80° C. with a stirring speed of 100 rpm for 1 hour to effect quaternarization reaction.

Thereafter while introducing nitrogen, 190 g of styrene, 90 g of butyl acrylate and 12 g of t-butylperoxy 2-ethylhexanoate (Arkema Yoshitomi Ltd.) as a peroxide initiator were added and the mixture was heated to 95° C. and stirred for 3 hours with a stirring speed of 100 rpm prior to further addition of 6 g of t-butylperoxy 2-ethylhexanoate and stirring for 3 hours with a stirring speed of 100 rpm to obtain a polymer solution. The solution was cooled to 60° C. and then added dropwise with 700 g of ion exchange water over 1 hour. The organic solvent was distilled off on a solvent removal device under a reduced pressure of 0.1 atm at 50° C. to obtain a water dispersion of an acrylic resin. To the dispersion were added 5 g of a cationic surfactant (Quartamin 24P, Kao Corporation)

and 150 g of a 0.1 N sodium hydroxide aqueous solution to prepare slurry which was then charged into a pressure resistant, round bottom stainless container and subjected to shear dispersion using a high speed shear emulsification device Clearmix (M Technique Co., Ltd.: CLM-2.2S) under heating and increased pressure of 150° C. and 0.5 MPa with a rotation speed of the rotor in the Cleamix of 20000 rpm for 30 minutes. The slurry was then cooled with a cooling rate of 5° C./min to 50° C. while stirring at 15000 rpm to obtain a resin fine particle dispersion A. The resin fine particles in the dispersion had a volume average particle diameter of 0.109 μm. The rate of copolymerization (%) of the quaternary ammonium salt of the diethylaminoethyl methacrylate monomer was 11.4%. The volume average particle diameter (D50) of the resin fine particles was determined with a particle diameter analyzer (LA-950 (Horiba. Ltd.)).

The monomer concentration (composition ratio) and the concentration of the monomer containing a quaternary ammonium group (the above rate of copolymerization) of the obtained resin fine particles are shown in Table 1 below.

(Acrylic Resin Fine Particle Dispersion B)

An acrylic resin fine particle dispersion B was obtained with the similar manner as the acrylic resin fine particle dispersion A except that the amount of diethylaminoethyl methacrylate was 54 g. the amount of methyl para-toluenesulfonate was 54 g, the amount of styrene was 150 g and the amount of butyl acrylate was 60 g. The resin fine particles in the dispersion had a volume average particle diameter of 0.066 μm. The rate of copolymerization (%) of the quaternary ammonium salt of the diethylaminoethyl methacrylate monomer was 34.0%. The monomer concentration (composition ratio) and the concentration of the monomer containing a quaternary ammonium group (the above rate of copolymerization) of the obtained resin fine particles are shown in Table 1 below.

(Acrylic Resin Fine Particle Dispersion C)

An acrylic resin fine particle dispersion C was obtained with the similar manner as the acrylic resin fine particle dispersion A except that the amount of diethylaminoethyl methacrylate was 32 g, the amount of methyl para-toluenesulfonate was 32 g, the amount of styrene was 175 g and the amount of butyl acrylate was 80 g. The resin fine particles in the dispersion had a volume average particle diameter of 0.094 μm. The rate of copolymerization (%) of the quaternary ammonium salt of the diethylaminoethyl methacrylate monomer was 20.1%. The monomer concentration (composition ratio) and the concentration of the monomer containing a quaternary ammonium group (the above rate of copolymerization) of the obtained resin fine particles are shown in Table 1 below.

(Acrylic Resin Fine Particle Dispersion D)

An acrylic resin fine particle dispersion D was obtained with the similar manner as the acrylic resin fine particle dispersion A except that dimethylaminoethyl methacrylate was used instead of diethylaminoethyl methacrylate. The resin fine particles in the dispersion had a volume average particle diameter of 0.087 μm. The rate of copolymerization (%) of the quaternary ammonium salt of the dimethylaminoethyl methacrylate monomer was 11.4%.

The monomer concentration (composition ratio) and the concentration of the monomer containing a quaternary ammonium group (the above rate of copolymerization) of the obtained resin fine particles are shown in Table 1 below.

(Acrylic Resin Fine Particle Dispersion E)

To a 2-L flask equipped with a stirrer, a condenser, a thermometer and a nitrogen introducing tube was added 180 g of isobutanol as a reaction solvent, 2 g of diethylaminoethyl methacrylate and 2 g of methyl para-toluenesulfonate were further added and the mixture was stirred under a nitrogen atmosphere at 80° C. with a stirring speed of 100 rpm for 1 hour to effect quaternarization reaction. Thereafter while introducing nitrogen, 19 g of styrene, 9 g of butyl acrylate and 1 g of t-butylperoxy 2-ethylhexanoate (Arkema Yoshitomi Ltd.) as a peroxide initiator were added and the mixture was heated to 95° C. and stirred for 3 hours with a stirring speed of 100 rpm prior to further addition of 0.5 g of t-butylperoxy 2-ethylhexanoate and stirring for 3 hours with a stirring speed of 100 rpm to obtain a core resin solution.

The solution was cooled to 50° C., added with, as a coating layer, 170 g of styrene, 80 g of butyl acrylate and 10 g of t-butylperoxy 2-ethylhexanoate, heated to 95° C. and stirred for 2 hours with a stirring speed of 100 rpm. To the mixture was added dropwise 700 g of ion exchange water over 1 hour. The organic solvent was distilled off on a solvent removal device under a reduced pressure of 0.1 atm at 50° C. to obtain a resin dispersion in water. To the dispersion were added 5 g of a cationic surfactant (Quartamin 24P, Kao Corporation) and 150 g of a 0.1 N sodium hydroxide aqueous solution to prepare slurry which was then charged into a pressure resistant, round bottom stainless container and subjected to shear dispersion using a high speed shear emulsification device Clearmix (M Technique Co., Ltd.: CLM-2.2S) under heating and increased pressure of 150° C. and 0.5 MPa with a rotation speed of the rotor in the Cleamix of 20000 rpm for 30 minutes. The slurry was then cooled with a cooling rate of 5° C./min to 50° C. while stirring at 15000 rpm to obtain an acrylic resin fine particle dispersion E. The resin fine particles in the dispersion had a volume average particle diameter of 0.133 μm. The rate of copolymerization (%) of the quaternary ammonium salt of the diethylaminoethyl methacrylate monomer was 1.3%. The monomer concentration (composition ratio) and the concentration of the monomer containing a quaternary ammonium group (the above rate of copolymerization) of the obtained resin fine particles are shown in Table 1 below.

(Acrylic Resin Fine Particle Dispersion F)

An acrylic resin fine particle dispersion F was obtained with the similar manner as the acrylic resin fine particle dispersion A except that the amount of diethylaminoethyl methacrylate was 65 g, the amount of methyl para-toluenesulfonate was 65 g, the amount of styrene was 135 g and the amount of butyl acrylate was 50 g. The resin fine particles in the dispersion had a volume average particle diameter of 0.068 μm. The rate of copolymerization (%) of the quaternary ammonium salt of the diethylaminoethyl methacrylate monomer was 41.3%. The monomer concentration (composition ratio) and the concentration of the monomer containing a quaternary ammonium group (the above rate of copolymerization) of the obtained resin fine particles are shown in Table 1 below.

(Acrylic Resin Fine Particle Dispersion G)

An acrylic resin fine particle dispersion G was obtained with the similar manner as the acrylic resin fine particle dispersion A except that the amount of diethylaminoethyl methacrylate was 65 g, the amount of methyl para-toluenesulfonate was 65 g, the amount of styrene was 0 g (no addition), the amount of butyl acrylate was 50 g and 135 g of methyl methacrylate was used. The resin fine particles in the dispersion had a volume average particle diameter of 0.072 μm. The rate of copolymerization (%) of the quaternary ammonium salt of the diethylaminoethyl methacrylate monomer was 41.3%. The monomer concentration (composition ratio) and the concentration of the monomer containing a quaternary ammonium group (the above rate of copolymerization) of the obtained resin fine particles are shown in Table 1 below.

(Acrylic Resin Fine Particle Dispersion H)

An acrylic resin fine particle dispersion H was obtained with the similar manner as the acrylic resin fine particle dispersion A except that the amount of diethylaminoethyl methacrylate was 90 g, the amount of methyl para-toluenesulfonate was 90 g, the amount of styrene was 110 g and the amount of butyl acrylate was 30 g. The resin fine particles in the dispersion had a volume average particle diameter of 0.065 μm. The rate of copolymerization (%) of the quaternary ammonium salt of the diethylaminoethyl methacrylate monomer was 56.3%. The monomer concentration (composition ratio) and the concentration of the monomer containing a quaternary ammonium group (the above rate of copolymerization) of the obtained resin fine particles are shown in Table 1 below.

(Acrylic Resin Fine Particle Dispersion I)

An acrylic resin fine particle dispersion I was obtained with the similar manner as the acrylic resin fine particle dispersion E except that the core resin solution was prepared with 1 g of diethylaminoethyl methacrylate, 1 g of methyl para-toluenesulfonate, 20 g of styrene and 10 g of butyl acrylate. The resin fine particles in the dispersion had a volume average particle diameter of 0.146 μm. The rate of copolymerization (%) of the quaternary ammonium salt of the diethylaminoethyl methacrylate monomer was 0.6%. The monomer concentration (composition ratio) and the concentration of the monomer containing a quaternary ammonium group (the above rate of copolymerization) of the obtained resin fine particles are shown in Table 1 below.

(Acrylic Resin Fine Particle Dispersion J)

An acrylic resin fine particle dispersion J was obtained with the similar manner as the acrylic resin fine particle dispersion A except that the amount of diethylaminoethyl methacrylate was 9 g, the amount of methyl para-toluenesulfonate was 9 g, the amount of styrene was 95 g and the amount of butyl acrylate was 45 g. The resin fine particles in the dispersion had a volume average particle diameter of 0.138 μm. The rate of copolymerization (%) of the quaternary ammonium salt of the diethylaminoethyl methacrylate monomer was 12.7%. The monomer concentration (composition ratio) and the concentration of the monomer containing a quaternary ammonium group (the above rate of copolymerization) of the obtained resin fine particles are shown in Table 1 below.

(Acrylic Resin Fine Particle Dispersion K)

An acrylic resin fine particle dispersion K was obtained with the similar manner as the acrylic resin fine particle dispersion A except that diethylaminoethyl methacrylate and methyl para-toluenesulfonate were not used, the amount of styrene was 205 g and the amount of butyl acrylate was 110 g. The resin fine particles in the dispersion had a volume average particle diameter of 0.124 μm. The monomer concentration (composition ratio) and the concentration of the monomer containing a quaternary ammonium group (rate of copolymerization) of the obtained resin fine particles are shown in Table 1 below.

(Acrylic Resin Fine Particle Dispersion L)

An acrylic resin fine particle dispersion L containing acrylic resin fine particles L for a shell layer was obtained by the similar manner as the acrylic resin fine particle dispersion A except that diethylaminoethyl methacrylate and methyl para-toluenesulfonate were not used, the amount of styrene was 95 g and the amount of butyl acrylate was 45 g. The resin fine particles in the dispersion had a volume average particle diameter of 0.204 μm. The monomer concentration (composition ratio) and the concentration of the monomer containing a quaternary ammonium group (rate of copolymerization) of the obtained resin fine particles are shown in Table 1 below.

Preparation Example 2

[Preparation of Colorant (Pigment) Fine Particle Dispersion]

20 g of an anionic surfactant (Emal 0, Kao Corporation) was dissolved in 410 g of ion exchange water. While stirring with a stirring speed of 150 rpm, to the solution was gradually added a cyan colorant, i.e., 70 g of copper phthalocyanine (trade name: CTBX121. DIC Corporation). The mixture was then emulsified on a homogenizer (Ultra-Turrax T50, IKA) for 5 minutes followed by further emulsification on a Gaulin homogenizer (Type 15M-8TA, APV) at 100° C. to prepare a colorant fine particle dispersion A. The colorant fine particles in the dispersion had a volume average particle diameter of 0.19 μm and a solid matter concentration of 14%. The volume average particle diameter of the colorant fine particles was determined with a particle diameter analyzer (LA-950 (Horiba. Ltd.)).

Preparation Example 3

[Preparation of Mould Release Agent Fine Particle Dispersion]

1 g of an anionic surfactant (Emal 0, Kao Corporation), 200 g of an ester wax (WEP-3 [melting temperature: 73° C.]. NOF Corporation) and 800 g of ion exchange water were mixed, heated to 100° C. to melt the ester wax, emulsified on a homogenizer (Ultra-Turrax T50, IKA) for 5 minutes followed by further emulsification on a Gaulin homogenizer (Type 15M-8TA, APV) at 70° C. to prepare a mould release agent dispersion A. The mould release agent fine particles in the dispersion had a volume average particle diameter of 0.15 μm and a solid matter concentration of 20%. The volume average particle diameter of the mould release agent fine particles was determined with a particle diameter analyzer (LA-950 (Horiba, Ltd.)).

Preparation Example 4

[Preparation of Silica]

100 g of dimethylpolysiloxane and 100 g of 3-aminopropyltrimethoxysilane (both from Shin-Etsu Chemical Co., Ltd.) were dissolved in 200 g of toluene to dilute to the factor of 10. To 200 g of fumed silica Aerosil #90 (Nippon Aerosil Co.) was gradually added dropwise the diluted solution while stirring with a stirring speed of 300 rpm, and ultrasonicated and stirred for 30 minutes to obtain a mixture. The mixture was heated in a high temperature incubator at 150° C. followed by distillation of toluene on a rotary evaporator. The resulting solid was dried in a reduced pressure dryer with a setting temperature of 50° C. until the weight was not decreased any more. The solid was further heated in an electric furnace under nitrogen flow at 200° C. for 3 hours. The obtained powder was pulverized on a jet mill and collected on a bag filter to obtain silica A.

Preparation Example 5

[Preparation of Carrier]

30 g of a polyamide-imide resin was diluted in 2 L of water in which 120 g of tetrafluoroethylene-hexafluoropropylene copolymer (FEP) and then 3 g of silicon oxide were dispersed to obtain a coating layer forming liquid. The coating layer forming liquid and 10 kg of non-coated ferrite EF-35B (Powdertech K.K., 35 μm) were charged in a fluidized bed coating machine to carry out coating. A carrier A was obtained after firing at 250° C. for 1 hour.

Example 1

<Aggregation Step>

To a 2-L stainless round bottom flask were charged at 25° C. 520 g of acrylic resin fine particle dispersion A [solid matter concentration: 30%], 150 g of mould release agent fine particle dispersion A [solid matter concentration: 20%], 100 g of colorant fine particle dispersion A [solid matter concentration: 14%], 40 g of a 25% aqueous solution of an anionic dispersing agent Emal 0 (Kao Corporation) and 190 g of distilled water to obtain a mixed dispersion. The mixed dispersion was stirred with a stirring blade at 100 rpm, added with 1 g of a 1 N sodium hydroxide aqueous solution in order to adjust pH of the mixed dispersion to 8 and stirred at 25° C. for 10 minutes.

To the mixed dispersion was then added dropwise 65 g of a magnesium chloride hexahydrate aqueous solution [solid matter concentration: 50%] over 5 minutes and the mixed dispersion was heated with a heating rate of 1° C./5 min to aggregate the fine particles. Heating was continued until the number average diameter of 4.5 μm was obtained as measured on a Multisizer III (Beckman Coulter Inc.) followed by discontinuation of heating at around 58° C. to obtain a fine particle aggregate dispersion containing fine particle aggregates. The fine particle aggregate dispersion was then heated with an increased stirring rotation speed of 200 rpm and a heating rate of 1° C./5 min to 68° C., stirred at 68° C. for 60 minutes to coalesce the components in the fine particle aggregates and obtain toner particles (toner mother particles). The toner particles had an average degree of circularity of 0.961 as determined on FPIA-3000 (Sysmex Corporation).

<Washing Step>

Solid-liquid separation was then carried out on a Buchner funnel by suction filtration. The filtered toner particles in the form of a wet cake were re-dispersed in ion exchange water and subjected to suction filtration again on a Buchner funnel. The solid-liquid separation was repeated five times.

<Drying Step>

The toner particles in the form of a wet cake after the washing step were dried at 40° C. and a pressure of 0.1 kPa for 72 hours to obtain toner mother particles A (toner particles) having a volume average diameter of 5.53 μm and an average degree of circularity of 0.963.

<External Addition Step>

The prepared toner mother particles A were subjected to external addition. To 100 g of the toner mother particles A was added 2 g of silica A and mixed on a 5-L Henschel mixer (Mitsui Miike Kakoki) for 5 minutes. The mixture was sieved on a sieve with #300 mesh (mesh size: 45 μm) to obtain toner A.

<Developer Preparation Step>

Thereafter 300 g of carrier A and 30 g of toner A were weighed in a 500-ml plastic bottle and mixed on a Turbula Shaker-Mixer (Shinmaru Enterprises Corporation, type T2F) for 30 minutes to prepare a developer A.

Example 2

Toner B was prepared with the similar manner as Example 1 except that the acrylic resin fine particle dispersion B [solid matter concentration: 30%] was used instead of the acrylic resin fine particle dispersion A, the fine particle aggregate dispersion was obtained by aggregating fine particles in the aggregation step with heating to about 62° C. of the mixed dispersion with a heating rate of 1° C./5 min and the fine particle aggregate dispersion was heated to 69° C. and stirred for 60 minutes to coalesce the components in the fine particle aggregates. The developer B was prepared from the toner B through the developer preparation step. The obtained toner B had a volume average diameter of 5.42 μm and an average degree of circularity of 0.963.

Example 3

Toner C was prepared with the similar manner as Example 1 except that the acrylic resin fine particle dispersion C [solid matter concentration: 30%] was used instead of the acrylic resin fine particle dispersion A, the fine particle aggregate dispersion was obtained by aggregating fine particles in the aggregation step with heating to about 60° C. of the mixed dispersion with a heating rate of 1° C./5 min and the fine particle aggregate dispersion was heated to 68° C. and stirred for 60 minutes to coalesce the components in the fine particle aggregates. The developer C was prepared from the toner C through the developer preparation step. The obtained toner C had a volume average diameter of 5.42 μm and an average degree of circularity of 0.963.

Example 4

Toner D was prepared with the similar manner as Example 1 except that the acrylic resin fine particle dispersion D [solid matter concentration: 30%] was used instead of the acrylic resin fine particle dispersion A, the fine particle aggregate dispersion was obtained by aggregating fine particles in the aggregation step with heating to about 60° C. of the mixed dispersion with a heating rate of ° C./5 min and the fine particle aggregate dispersion was heated to 68° C. and stirred for 60 minutes to coalesce the components in the fine particle aggregates. The developer D was prepared from the toner D through the developer preparation step. The obtained toner D had a volume average diameter of 5.59 μm and an average degree of circularity of 0.964.

Example 5

Toner E was prepared with the similar manner as Example 1 except that the acrylic resin fine particle dispersion E [solid matter concentration: 30%] was used instead of the acrylic resin fine particle dispersion A, the fine particle aggregate dispersion was obtained by aggregating fine particles in the aggregation step with heating to about 55° C. of the mixed dispersion with a heating rate of 1° C./5 min and the fine particle aggregate dispersion was heated to 67° C. and stirred for 60 minutes to coalesce the components in the fine particle aggregates. The developer E was prepared from the toner E through the developer preparation step. The obtained toner E had a volume average diameter of 5.68 μm and an average degree of circularity of 0.959.

Example 6

Toner F was prepared with the similar manner as Example 1 except that the acrylic resin fine particle dispersion F [solid matter concentration: 30%] was used instead of the acrylic resin fine particle dispersion A, the fine particle aggregate dispersion was obtained by aggregating fine particles in the aggregation step with heating to about 54° C. of the mixed dispersion with a heating rate of 1° C./5 min and the fine particle aggregate dispersion was heated to 66° C. and stirred for 60 minutes to coalesce the components in the fine particle aggregates. The developer F was prepared from the toner F through the developer preparation step. The obtained toner F had a volume average diameter of 5.49 μm and an average degree of circularity of 0.968.

Example 7

Toner G was prepared with the similar manner as Example 1 except that the acrylic resin fine particle dispersion G [solid matter concentration: 30%] was used instead of the acrylic resin fine particle dispersion A, the fine particle aggregate dispersion was obtained by aggregating fine particles in the aggregation step with heating to about 55° C. of the mixed dispersion with a heating rate of 1° C./5 min and the fine particle aggregate dispersion was heated to 68° C. and stirred for 60 minutes to coalesce the components in the fine particle aggregates. The developer G was prepared from the toner G through the developer preparation step. The obtained toner G had a volume average diameter of 5.53 μm and an average degree of circularity of 0.971.

Comparative Example 1

Toner H was prepared with the similar manner as Example 1 except that the acrylic resin fine particle dispersion H [solid matter concentration: 30%] was used instead of the acrylic resin fine particle dispersion A, the fine particle aggregate dispersion was obtained by aggregating fine particles in the aggregation step with heating to about 63° C. of the mixed dispersion with a heating rate of 1° C./5 min and the fine particle aggregate dispersion was heated to 67° C. and stirred for 60 minutes to coalesce the components in the fine particle aggregates. The developer H was prepared from the toner H through the developer preparation step. The obtained toner H had a volume average diameter of 5.55 μm and an average degree of circularity of 0.967.

Comparative Example 2

Toner I was prepared with the similar manner as Example 1 except that the acrylic resin fine particle dispersion I [solid matter concentration: 30%] was used instead of the acrylic resin fine particle dispersion A, the fine particle aggregate dispersion was obtained by aggregating fine particles in the aggregation step with heating to about 55° C. of the mixed dispersion with a heating rate of 1° C./5 min and the fine particle aggregate dispersion was heated to 68° C. and stirred for 60 minutes to coalesce the components in the fine particle aggregates. The developer I was prepared from the toner I through the developer preparation step. The obtained toner I had a volume average diameter of 5.71 μm and an average degree of circularity of 0.958.

Comparative Example 3

The acrylic resin fine particle dispersion J [solid matter concentration 30%] was used instead of the acrylic resin fine particle dispersion A, the fine particles were aggregated by heating the mixed dispersion in the aggregation step to about 62° C. with a heating rate of 1° C./5 min and the particles were coalesced by heating to 66° C. and stirring for 60 minutes.

Thereafter as a shell layer, 78 g of acrylic resin fine particle dispersion L [Tm: 103.1° C./Tg: 60.5° C./particle diameter: 0.204 μm/solid matter concentration: 30%] was added and the mixture was heated to 75° C. with a heating rate of 1° C./5 min and stirred at 75° C. for 2 hours to make a film of the acrylic resin fine particles L.

Toner J was prepared with the similar manner as Example 1 except for the above and the developer J was prepared therefrom through the developer preparation step. The core-shell type toner J had a volume average diameter of 5.33 μm and an average degree of circularity of 0.961.

Comparative Example 4

Toner K was prepared with the similar manner as Example 1 except that the acrylic resin fine particle dispersion K [solid matter concentration: 30%] was used instead of the acrylic resin fine particle dispersion A, the fine particle aggregate dispersion was obtained by aggregating fine particles in the aggregation step with heating to about 63° C. of the mixed dispersion with a heating rate of 1° C./5 min and the fine particle aggregate dispersion was heated to 67° C. and stirred for 60 minutes to coalesce the components in the fine particle aggregates. The developer K was prepared from the toner K through the developer preparation step. The obtained toner K had a volume average diameter of 5.64 μm and an average degree of circularity of 0.962.

<<Evaluation Methods>>

Toners and developers obtained in Examples 1 to 7 and Comparative Examples 1 to 4 were evaluated according to the methods described hereinbelow. The evaluation results are shown in Table 1.

(Hydrophobicity)

Hydrophobicity (methanol wettability) is defined as follows:

$$\text{Hydrophobicity}=(\text{amount of methanol}/(\text{amount of ion exchange water}+\text{amount of methanol}))\times 100(\%).$$

1 g of toner which had been left to stand at 20° C./65% R.H. for 24 hours and 100 ml of ion exchange water were weighed in a 300-ml beaker and stirred on a stirrer at 100 rpm for 10 minutes. Thereafter methanol was added at a rate of 2 ml per minute and the hydrophobicity was determined from the amount of methanol added when toner started to precipitate. The hydrophobicity of toner was determined on a powder wettability tester (WET-100P, Rhesca Corporation).

(Rate of Stacked Units)

The rate of stacked units was calculated based on the mole ratio of the starting materials (loaded amount).

(Tg)

Tg (° C.) of toner was determined on a flowtester. A measurement instrument was a differential scanning calorimeter DSC-200 from Seiko Instruments Inc. and the glass transition point was determined by measuring an endothermic curve of toner by the method according to JIS K 7121-1987. Specifically, 10 mg of toner was placed in an aluminium pan and an empty pan was used as a reference. Measurement was carried out under normal temperature and normal humidity within the measurement point range of 25° C. or higher and 200° C. or lower and with a heating rate of 10° C./min. The glass transition point of toner was determined from the resulting endothermic curve of toner.

(Storage Stability)

3 g of toner was weighed in a 20-g plastic container, heated in an oven at 60° C. for 3 hours or 48 hours and removed from the oven. The toner was then left to stand in an atmosphere of 25° C. and 65% R.H. for 30 minutes, then placed on stacked sieves having mesh sizes of 105 μm, 63 μm and 45 μm, vibrated on a powder tester for 30 seconds with the setting of the scale of 5 in order to calculate the degree of aggregation after high temperature storage according to the following formulae.

(Weight of toner on the sieve with 105 μm)/3×100 (a)

(Weight of toner on the sieve with 63 μm)/3×100×3/5 (b)

(Weight of toner on the sieve with 45 μm)/3×100×1/5 (c)

Degree of aggregation(%)=(*a*)+(*b*)+(*c*)

The evaluation criteria was as follows.

○: Degree of aggregation of less than 2%

Δ: Degree of aggregation of 2% or more and less than 8% x: Degree of aggregation of 8% or more (Fogging and Charged Amount)

On a colour multifunctional peripheral from Kyocera Mita Corporation (TASKalfa 5550ci), 5000 sheets of 2% colour character pattern were continuously printed followed by 1000-sheet continuous printing of 50% colour patch pattern, with 4 colour toners (genuine toners other than cyan) under an atmosphere of 20° C./65% R.H. The maximum fogging density on the white background in the patch pattern was measured and evaluated according to the following criteria (the value was obtained by subtracting the image density of a printing paper before printing).

○: Maximum fogging density of less than 0.004

Δ: Maximum fogging density of 0.004 or more and less than 0.010 x: Maximum fogging density of 0.010 or more

The variation in the charged amount after 2% character pattern output and after 50%/o patch pattern output was calculated and evaluated according to the following criteria.

○: Less than 7 μC/g x: 7 μC/g or more

TABLE 1

| Sample | | Core resin: Monomer composition | | | | | Shell resin: Monomer Composition | | Toner physical properties Physical properties | |
|---|---|---|---|---|---|---|---|---|---|---|
| | Developer | Conc. of monomer having quaternary ammonium group (%) | Conc. of styrene monomer (%) | Conc. of methyl methacrylate monomer (%) | Conc. of butyl acrylate monomer (%) | Rate of stacked units | Conc. of styrene monomer (%) | Conc. of butyl acrylate monomer (%) | Hydrophobicity (%) | Tg (%) |
| Ex. 1 | A | 11.4 | 60.1 | 0.0 | 28.5 | None | — | — | 13 | 58.8 |
| Ex. 2 | B | 34.0 | 47.2 | 0.0 | 18.0 | None | — | — | 8 | 58.1 |
| Ex. 3 | C | 20.1 | 54.9 | 0.0 | 25.1 | None | — | — | 10 | 58.1 |
| Ex. 4 | D | 11.4 | 60.1 | 0.0 | 28.5 | None | — | — | 13 | 59.0 |
| Ex. 5 | E | 1.3 | 65.3 | 0.0 | 33.4 | 11.2% | — | — | 39 | 58.1 |
| Ex. 6 | F | 41.3 | 42.9 | 0.0 | 15.9 | None | — | — | 7 | 57.6 |
| Ex. 7 | G | 41.3 | 0.0 | 42.9 | 15.9 | None | — | — | 6 | 57.6 |
| Com. Ex. 1 | H | 55.3 | 34.4 | 0.0 | 9.4 | None | — | — | 6 | 57.1 |
| Comp. Ex. 2 | I | 0.6 | 65.2 | 0.0 | 34.2 | 5.5% | — | — | 56 | 57.5 |
| Comp. Ex. 3 | J | 12.7 | 60.1 | 0.0 | 28.5 | None | 67.9 | 32.1 | 91 | 58.8 |
| Comp. Ex. 4 | K | 0.0 | 65.1 | 0.0 | 34.9 | None | — | — | 95 | 56.8 |

| Sample | | Toner performances: Storage stability | | Fogging | | Charged amount | | |
|---|---|---|---|---|---|---|---|---|
| | Developer | Degree of aggregation (%) | Judgement | | Judgement | After 50% printing | Amount of variation | Judgement |
| Ex. 1 | A | 0.7 | ○ | 0.002 | ○ | 15.2 | 4.9 | ○ |
| Ex. 2 | B | 0.2 | ○ | 0.001 | ○ | 21.3 | 2.0 | ○ |
| Ex. 3 | C | 0.5 | ○ | 0.002 | ○ | 18.5 | 3.7 | ○ |
| Ex. 4 | D | 1.2 | ○ | 0.002 | ○ | 17.5 | 5.3 | ○ |
| Ex. 5 | E | 1.6 | ○ | 0.003 | ○ | 12.6 | 6.7 | ○ |
| Ex. 6 | F | 0.3 | ○ | 0.002 | ○ | 22.8 | 2.2 | ○ |
| Ex. 7 | G | 0.5 | ○ | 0.003 | ○ | 30.1 | 1.8 | ○ |
| Com. Ex. 1 | H | 8.7 | X | 0.001 | ○ | 23.6 | 2.3 | ○ |
| Comp. Ex. 2 | I | 24.6 | X | 0.005 | Δ | 9.2 | 7.1 | X |
| Comp. Ex. 3 | J | 7.3 | Δ | 0.004 | Δ | 13.1 | 8.2 | X |
| Comp. Ex. 4 | K | 27.9 | X | 0.010 | X | 8.7 | 2.7 | ○ |

<<Discussion>>

It is found from Examples 1 to 7 that toners of the present disclosure have excellent storage stability, i.e., as dispersing agent or metal ion do not remain in the aggregated state, they can be removed with normal cleaning. Therefore excellent developers were obtained which have excellent charging ability without causing image defects such as fogging.

On the other hand, it is found from the result of Comparative Example 1 having excessively high concentration of quaternary ammonium group that although the obtained toner particles had decreased hydrophobicity, fine particles were aggregated and the result of storage stability was inferior to Examples.

The toner and developer of Comparative Example 2 having excessively low concentration of quaternary ammonium group had impaired storage stability, fogging and charging ability compared to Examples.

From the result of Comparative Example 3 which toner contained a shell layer of resin, it is found that, because the surface is hydrophobic in spite of high concentration of quaternary ammonium group, the hydrophobicity was not decreased and thus the storage stability (residual dispersing agent and the like) and charging ability were impaired.

In Comparative Example 4 which contained a binder resin without quaternary ammonium group, the hydrophobicity was excessively high and the storage stability was impaired compared to Examples. Further, because of insufficient positive charge, fogging occurred and the formed images were defective.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A positively chargeable toner for electrostatic image development comprising: a coalesced fine particle aggregate of a binder resin, a colorant, a dispersing agent, and a metal ion, wherein the binder resin includes at least 70 wt. % of a (meth)acrylic resin or styrene-(meth)acrylic resin having quaternary ammonium groups, wherein the (meth)acrylic resin or styrene-(meth)acrylic resin has a concentration of a monomer, which has the quaternary ammonium group, which is 1 to 45% by mass of the (meth)acrylic resin or styrene-(meth)acrylic resin, and wherein the toner has a hydrophobicity (methanol wettability) of 5% to 40%.

2. A developer for electrostatic image development comprising the toner according to claim 1 and a carrier.

3. The positively chargeable toner of claim 1, wherein the (meth)acrylic resin or styrene-(meth)acrylic resin has a glass transition point (Tg) of 40° C. to 80° C.

4. The positively chargeable toner of claim 1, wherein the binder resin consists of the (meth)acrylic resin or styrene-(meth)acrylic resin.

* * * * *